US011090970B2

(12) United States Patent
Mazingue et al.

(10) Patent No.: US 11,090,970 B2
(45) Date of Patent: Aug. 17, 2021

(54) WRITING INSTRUMENT WITH ERASING DEVICE

(71) Applicant: SOCIETE BIC, Clichy (FR)

(72) Inventors: Laurent Mazingue, Paris (FR); Laurent Beaucher, Chennevières sur Marne (FR); Ludovic Fagu, Livry Gargan (FR); Etienne Roudaut, La garenne colombes (FR)

(73) Assignee: SOCIETE BIC, Clichy (FR)

( * ) Notice: Subject to any disclaimer, the term of this patent is extended or adjusted under 35 U.S.C. 154(b) by 0 days.

(21) Appl. No.: 16/547,887

(22) Filed: Aug. 22, 2019

(65) Prior Publication Data

US 2020/0062023 A1 Feb. 27, 2020

(30) Foreign Application Priority Data

Aug. 22, 2018 (FR) ..... 1857598

(51) Int. Cl.
*B43K 29/02* (2006.01)
*B43K 24/06* (2006.01)

(52) U.S. Cl.
CPC ..... *B43K 29/02* (2013.01); *B43K 24/06* (2013.01)

(58) Field of Classification Search
CPC ..... B43K 24/02; B43K 24/06; B43K 24/082; B43K 24/16; B43K 29/02; B43L 19/0056; B43L 19/0068; B43L 19/0075; B43L 19/0081
See application file for complete search history.

(56) References Cited

U.S. PATENT DOCUMENTS

| | | | | |
|---|---|---|---|---|
| 100,189 A * | 2/1870 | Richards | B43K 29/02 15/432 |
| 423,568 A | 3/1890 | Mussinan, Jr. | |
| 921,456 A | 5/1909 | Pumphrey | |
| 2,370,831 A * | 3/1945 | Averill | B43K 29/02 15/432 |
| 2,803,219 A * | 8/1957 | Stoeberl | B43K 7/12 401/112 |
| 2,986,119 A * | 5/1961 | Roesler | B43K 24/082 401/105 |

(Continued)

FOREIGN PATENT DOCUMENTS

WO 2016/167183 10/2016

OTHER PUBLICATIONS

French Search Report in French priority patent application No. 1857598, 2 pages.

(Continued)

*Primary Examiner* — David P Angwin
*Assistant Examiner* — Bradley S Oliver
(74) *Attorney, Agent, or Firm* — Ohlandt, Greeley, Ruggiero & Perle, L.L.P.

(57) ABSTRACT

A writing instrument comprising a body extending along an axial direction and an erasing device comprising an eraser, the erasing device being disposed at an axial end of the body of the writing instrument, the eraser being able to assume a use position and a protection position, the eraser being configured to switch from the use position to the protection position by a displacement of the eraser by means of an actuation device of the erasing device, the actuation device being configured to be actuated along a axis perpendicular to the axial direction.

12 Claims, 8 Drawing Sheets

(56) References Cited

U.S. PATENT DOCUMENTS

| | | | | |
|---|---|---|---|---|
| 4,917,519 | A * | 4/1990 | White | B43K 24/06 401/109 |
| 7,329,063 | B2 * | 2/2008 | Kato | B43K 7/005 401/116 |
| 10,603,950 | B2 * | 3/2020 | Bez | A45D 40/24 |
| 2007/0189836 | A1 * | 8/2007 | Senga | B43K 7/10 401/195 |

OTHER PUBLICATIONS

Written Opinion of the French Search Report in French priority patent application No. 1857598, 6 pages.

* cited by examiner

WRITING INSTRUMENT WITH ERASING DEVICE

CROSS REFERENCE TO RELATED APPLICATIONS

This application claims priority to French Application No. FR1857598, filed Aug. 22, 2018, the entire contents of which is incorporated herein by reference.

FIELD

The present disclosure relates to the hand-held writing instruments comprising an eraser.

BACKGROUND

In the following description, it is meant by "eraser" a pencil eraser, a non-thermochromic ink eraser such as, for example, inks called "peelable" inks and/or a thermochromic ink eraser, also called friction member.

To prevent the eraser from getting dirty when not in use, some hand-held writing instruments comprise a cap for protecting the eraser. However, this cap can be lost and the eraser no longer protected.

SUMMARY

The present disclosure aims at overcoming at least part of these drawbacks.

To this end, the present disclosure relates to a writing instrument comprising a body extending along an axial direction and an erasing device comprising an eraser, the erasing device being disposed at an axial end of the body of the writing instrument, the eraser being able to assume a use position and a protection position, the eraser being configured to switch from the use position to the protection position by a displacement of the eraser by means of an actuation device of the erasing device, the actuation device being configured to be actuated along an axis perpendicular to the axial direction.

The eraser moves to switch from the use position to the protection position and vice versa, the eraser is protected.

In some embodiments, the erasing device comprises an eraser holder.

For example, the eraser holder can be made of thermoplastic polymer, such as acrylonitrile-butadiene-styrene (ABS).

In some embodiments, the erasing device comprises a stop member configured to maintain the eraser in the use position.

In some embodiments, the erasing device comprises a blocking member configured to maintain the eraser in the protection position.

In some embodiments, the displacement of the eraser comprises a rotational component.

In some embodiments, the displacement of the eraser comprises a translational component.

In some embodiments, the actuation device is formed by the erasing device.

In some embodiments, the erasing device and the actuation device are separate from each other.

In some embodiments, the writing instrument comprises a writing head able to assume a writing position in which the writing head protrudes from the body and a retracted position in which the writing head is stowed into the body, wherein the actuation device is configured such that, when the eraser is in the use position, the writing head is in the writing position and when the eraser is in the protection position, the writing head is in the retracted position.

In some embodiments, the eraser is a friction member for thermochromic ink.

For example, the eraser can be made of ether-based thermoplastic polyurethane (also called TPU).

In some embodiments, the eraser may be a pencil eraser.

In some embodiments, the eraser may be a peelable ink eraser.

In some embodiments, the eraser and the eraser holder can be made of the same material.

The eraser and the eraser holder can be assembled together or directly formed into one piece.

In some embodiments, when the eraser and the eraser holder are made of the same material, the material of the eraser may have a different color from the material of the eraser holder.

BRIEF DESCRIPTION OF THE DRAWINGS

Other characteristics and advantages of the object of the present disclosure will become apparent from the following description of embodiments, given by way of non-limiting examples, with reference to the appended figures, in which.

In all the figures, the members in common are identified by identical reference numerals.

DETAILED DESCRIPTION

Figure 1:
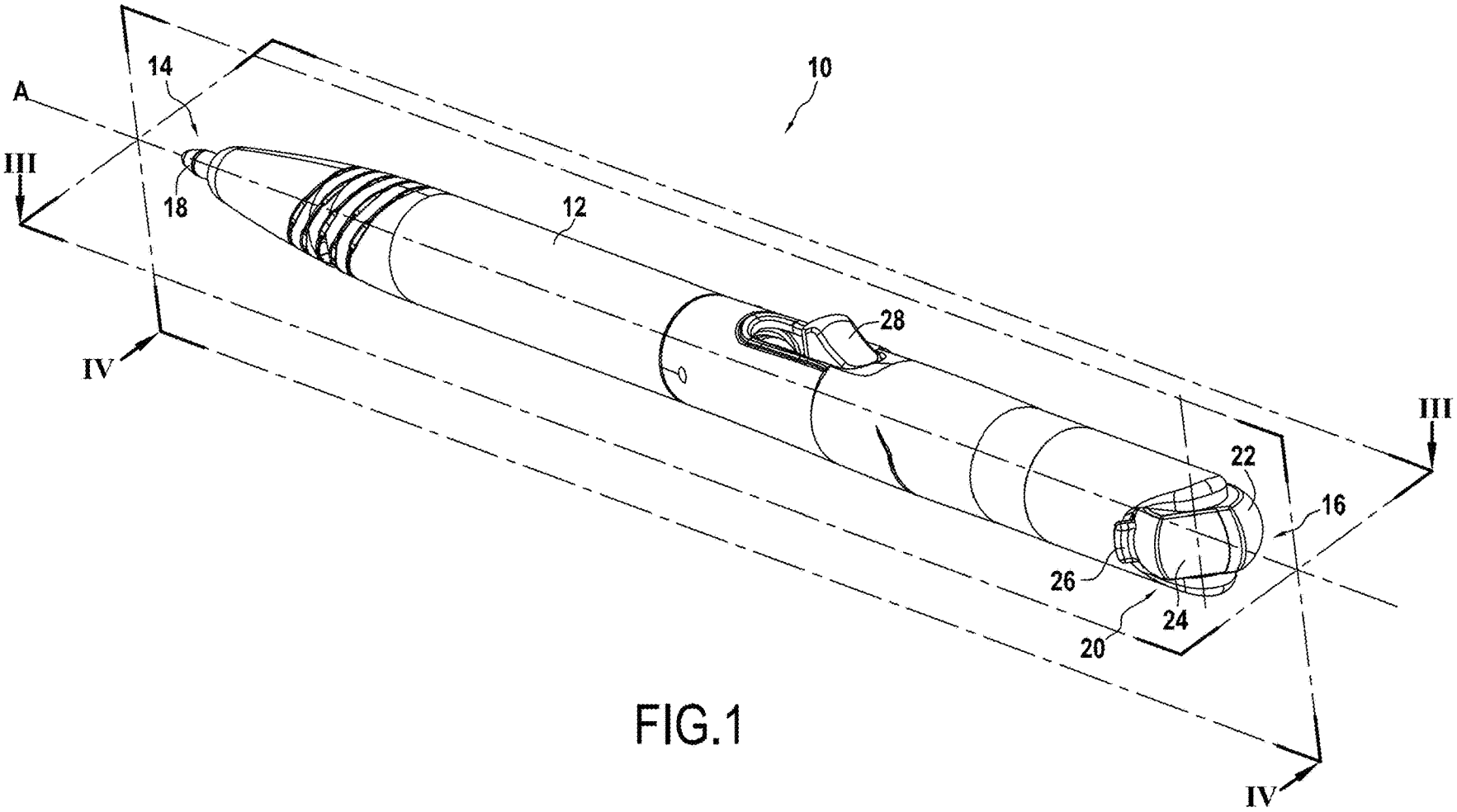
FIG. 1 is a perspective view of a writing instrument according to a first embodiment wherein the eraser is in the use position.

FIG. 1 details a hand-held writing instrument 10 comprising a body 12 extending along an axial direction A. The body 12 of the writing instrument 10 includes a first axial end 14 and a second axial end 16. The first axial end 14 includes a writing head 18 and the second axial end 16 includes an erasing device 20.

In the embodiment of FIG. 1, the erasing device 20 comprises an eraser 22 received in an eraser holder 24.

Figure 2:
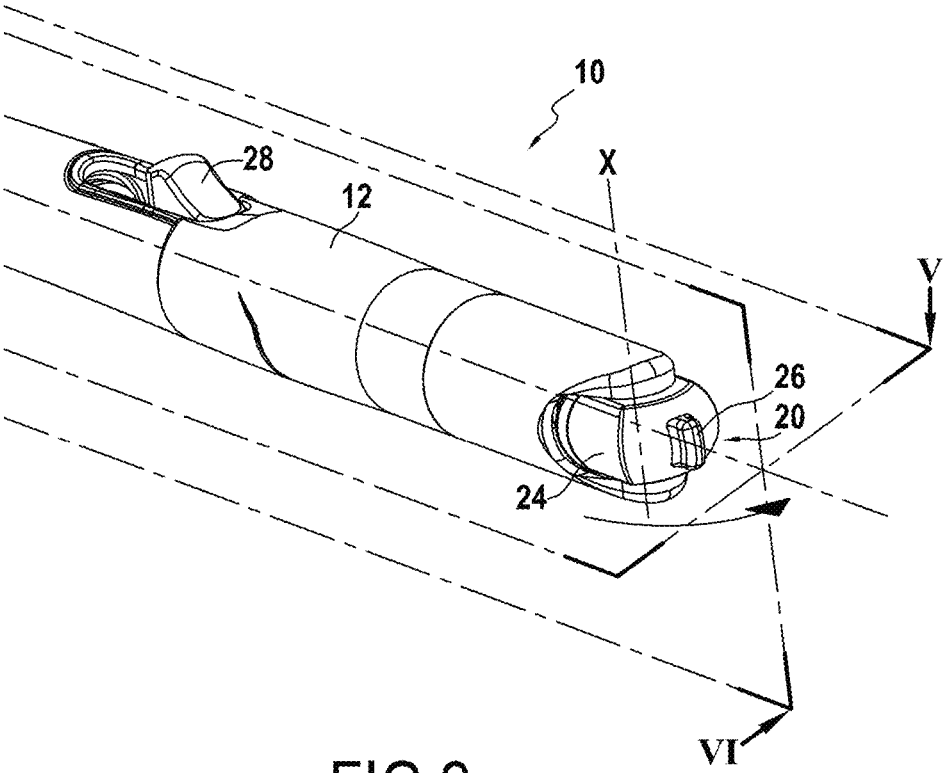
FIG. 2 is a partial perspective view of the writing instrument of FIG. 1 wherein the eraser is in the protection position.
Figure 3:
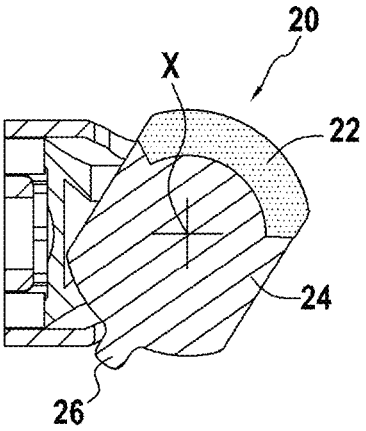
FIGS. 3 and 4 are sectional views respectively along the section planes III-III and IV-IV of FIG. 1.
Figure 4:
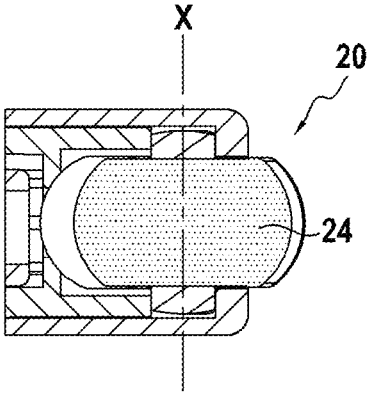
Figure 5:
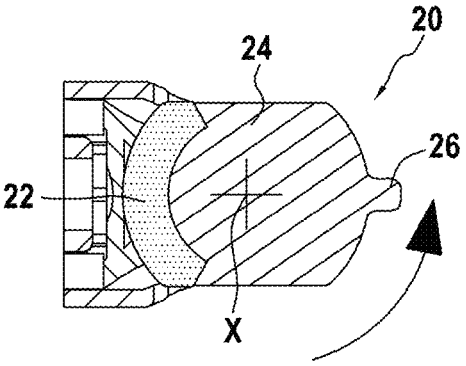
FIGS. 5 and 6 are sectional views respectively along the section planes V-V and VI-VI of FIG. 2.
Figure 6:
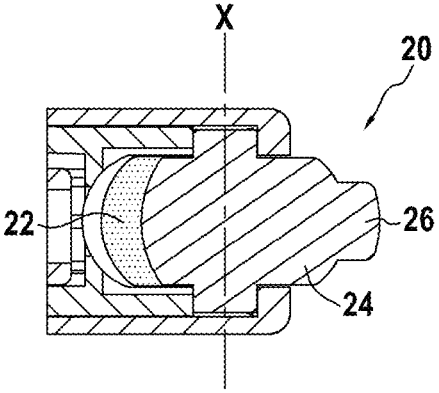

In FIGS. 1, 3 and 4, the eraser 22 is represented in the use position while in FIGS. 2, 5 and 6, the eraser 22 is represented in the protection position.

In the embodiment of FIGS. 1 to 6, in the protection position, the eraser 22 is received in the body 12 of the writing instrument 10.

The eraser holder 24 comprises a stop member allowing to maintain the eraser in the use position. In the embodiment of FIGS. 1 and 2, the stop member is a lug 26.

The erasing device 20, particularly the eraser holder 24, is pivotally mounted on the second axial end 16 of the body 12 of the writing instrument 10 about an axis X which is perpendicular to the axial direction A.

The writing instrument 10 includes a lateral button 28 for actuating the writing head 18. The button 28 allows the switching of the writing head 18 between a writing position in which the writing head 18 protrudes from the body 12 of the writing instrument 10 and a retracted position in which the writing head 18 is stowed into the body 12 of the writing instrument 10 and vice versa. It is understood that the button 28 is not limited to the button represented in FIGS. 1 and 2.

Alternatively, the writing head 18 of the writing instrument 10 could be fixed, in the writing position. The writing instrument 10 would then not comprise a button.

In the embodiment of FIGS. 1 and 2, the switching from the use position to the protection position of the eraser 22 is independent of the switching from the writing position to the retracted position of the writing head 18.

The eraser 22 can be overmolded on the eraser holder 24 or vice versa. The eraser 22 can also be snapped into the eraser holder 24 or vice versa.

In the embodiment of FIGS. 1 to 6, the actuation device is formed by the erasing device 20, particularly when a user wishes to switch the eraser 22 from the use position to the protection position or vice versa, the user makes the erasing device 20 pivot about the axis X. Particularly, to switch from the protection position to the use position, the user can perform a rotational movement of the erasing device 20, that is to say of the actuation device, bearing on the lug 26. The actuation device is therefore actuated along the axis X. Similarly, to switch from the use position to the protection position, the user can perform a rotational movement of the erasing device 20, that is to say of the actuation device, by bearing on the lug 26. The actuation device is therefore actuated along the X axis. The eraser 22 switches from the use position to the protection position by a rotational movement of the eraser 22 about the axis X.

The eraser 22 may be a friction member for thermochromic ink and/or peelable ink.

In the following, the members common to the various embodiments are identified by the same reference numerals.

The embodiment of FIGS. 7 to 10 differs from the embodiment of FIGS. 1 to 6 in that the eraser holder 24 has a general shape of a toothed wheel rotatable about the X axis, which is perpendicular to the axial direction A, and including teeth 38 at the periphery of the toothed wheel.

The embodiment of FIGS. 7 to 10 differs from the embodiment of FIGS. 1 to 6 in that the eraser 22 has a general shape of a cylinder wall section.

For example, the eraser 22 may be overmolded on the eraser holder 24.

The erasing device 20, particularly the eraser holder 24, is pivotally mounted on the second axial end 16 of the body 12 of the writing instrument 10 about an axis X which is perpendicular to the axial direction. A.

In the embodiment of FIGS. 7 to 10, the body 12 of the writing instrument 10 comprises a cover 30 for protecting the eraser 22. The cover 30 is fixed, that is to say the cover 30 is not detachable from the body 12 of the writing instrument 10.

Figure 7:
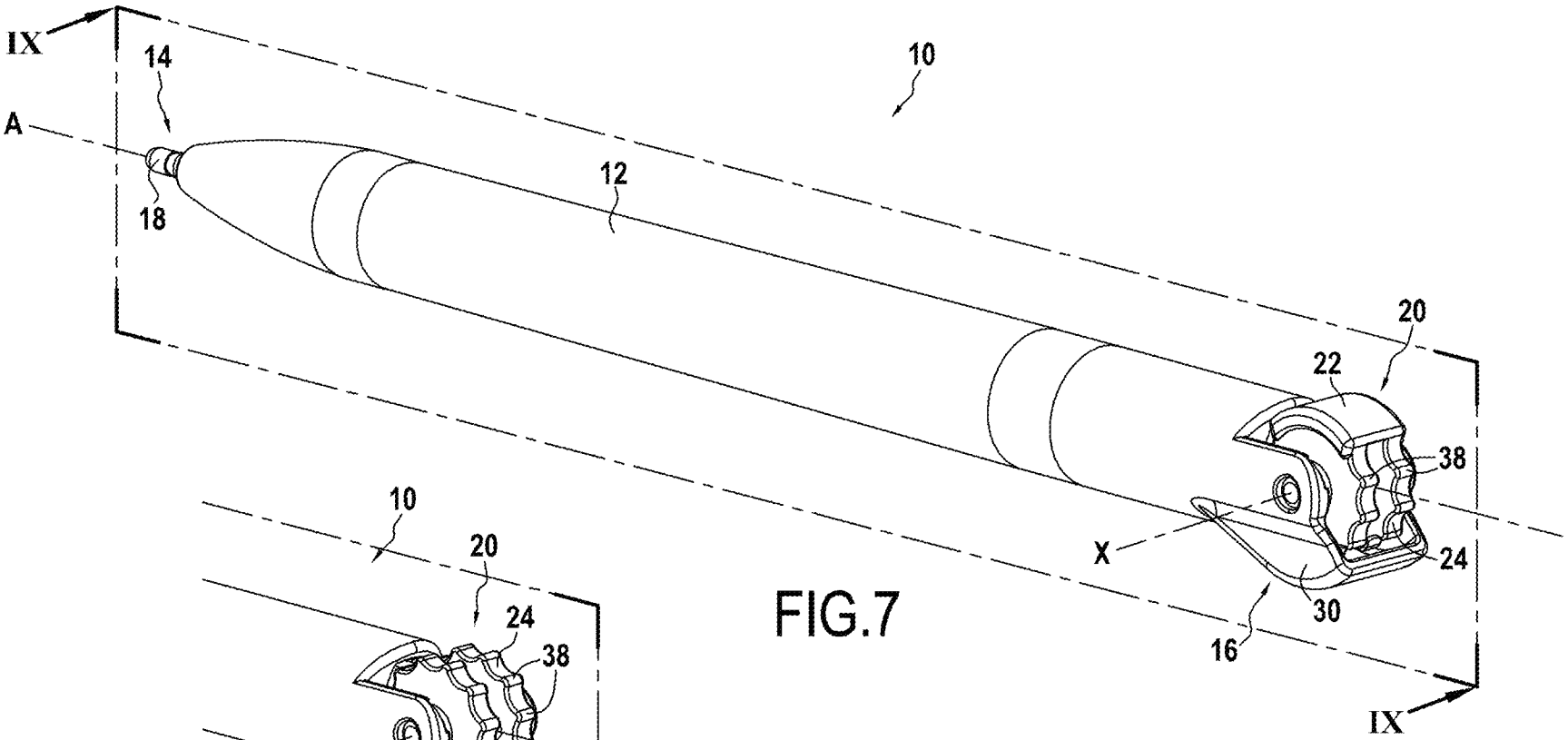
FIG. 7 is a perspective view of a writing instrument according to a second embodiment wherein the eraser is in the use position.
Figure 8:
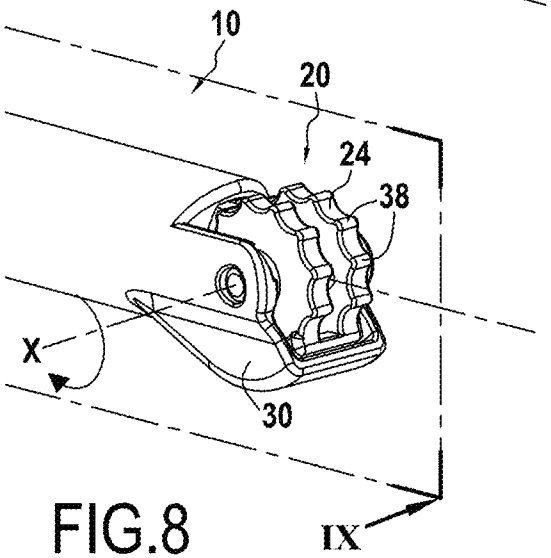
FIG. 8 is a partial perspective view of the writing instrument of FIG. 7 wherein the eraser is in the protection position.
Figure 9:
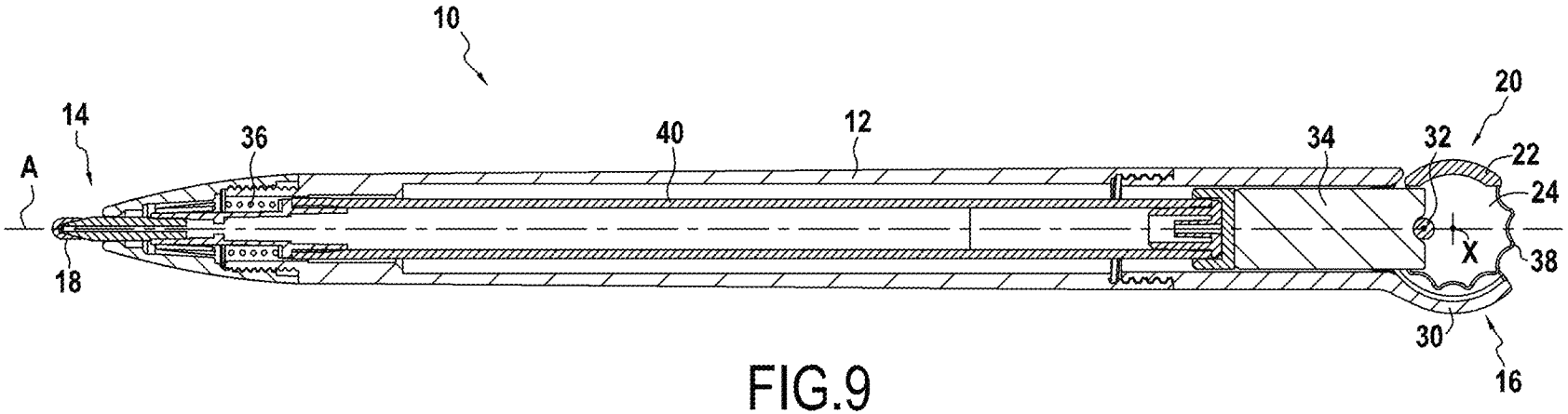
FIG. 9 is a sectional view along the section plane IX-IX of FIG. 7.
Figure 10:
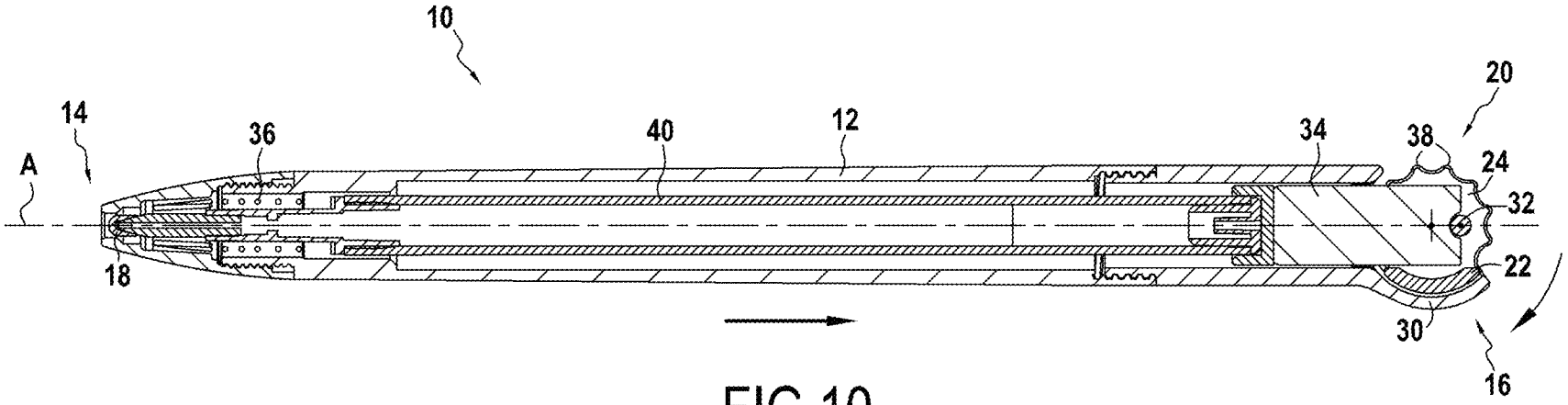
FIG. 10 is a sectional view along section plane X-X of FIG. 8.
Figure 11:
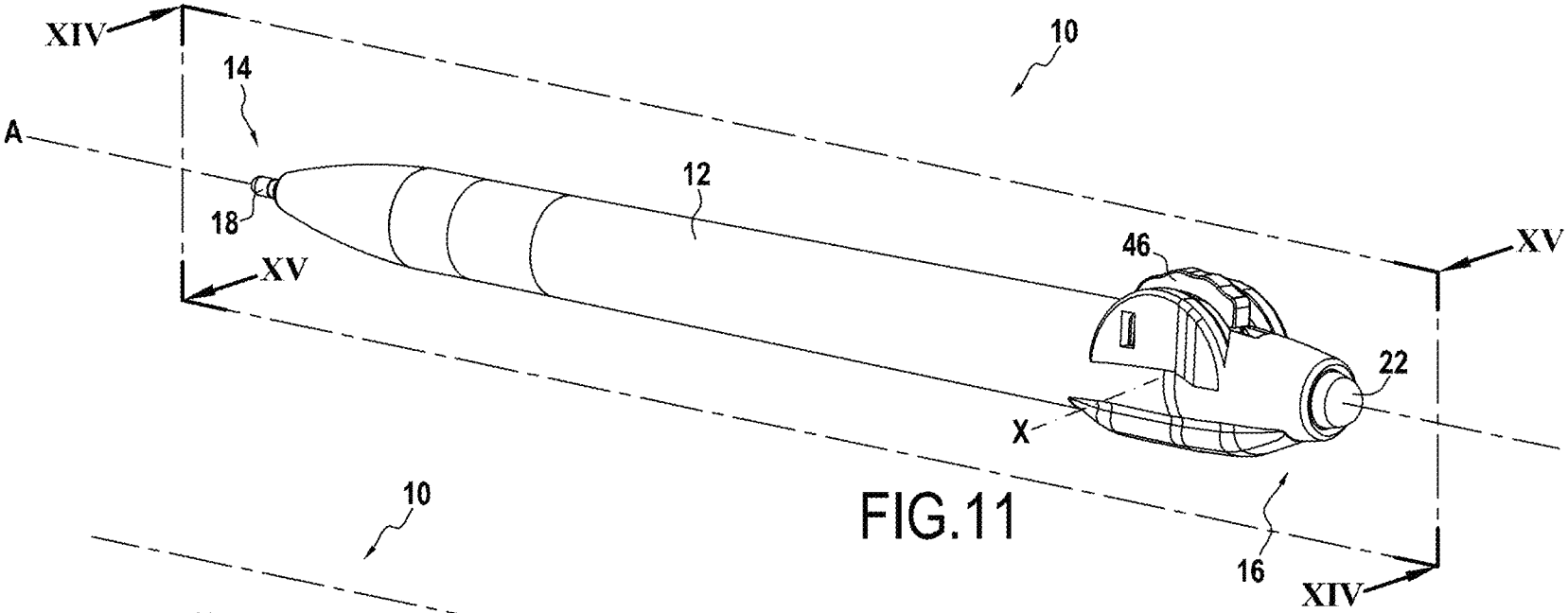
FIG. 11 is a perspective view of a writing instrument according to a third embodiment wherein the eraser is in the use position.
Figure 12:
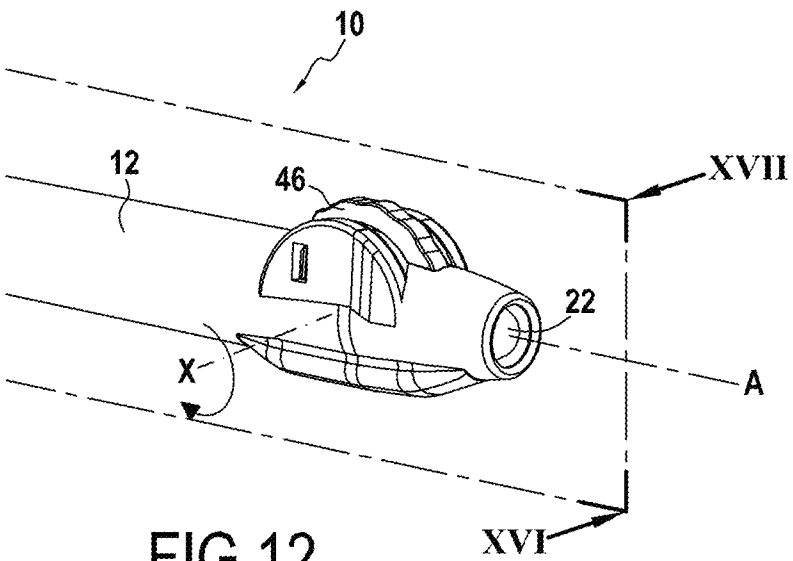
FIG. 12 is a partial perspective view of the writing instrument of FIG. 11 wherein the eraser is in the protection position.
Figure 13:
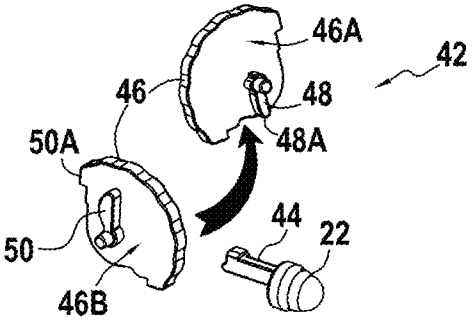
FIG. 13 is an exploded view of the actuation device of the writing instrument of FIGS. 11 and 12.
Figure 14:
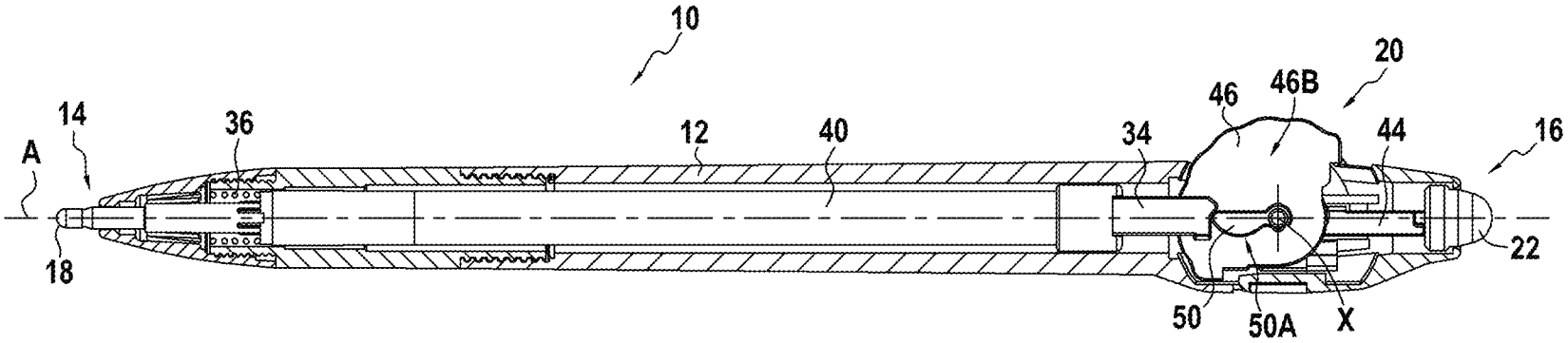
FIGS. 14 and 15 are sectional views respectively along section planes XIV-XIV and XV-XV of FIG. 11.
Figure 15:
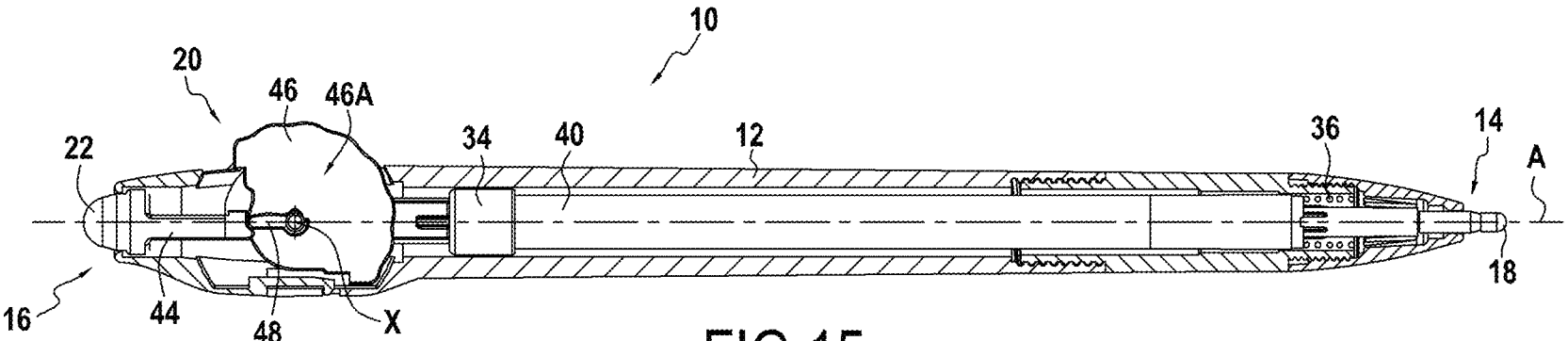
Figure 16:
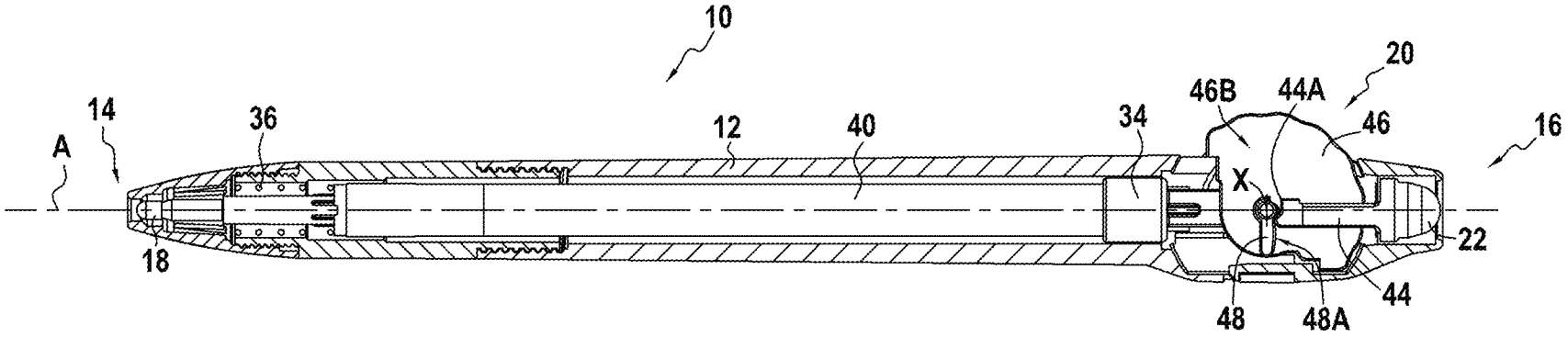
FIGS. 16 and 17 are sectional views respectively along the section planes XVI-XVI and XVII-XVII of FIG. 12.
Figure 17:
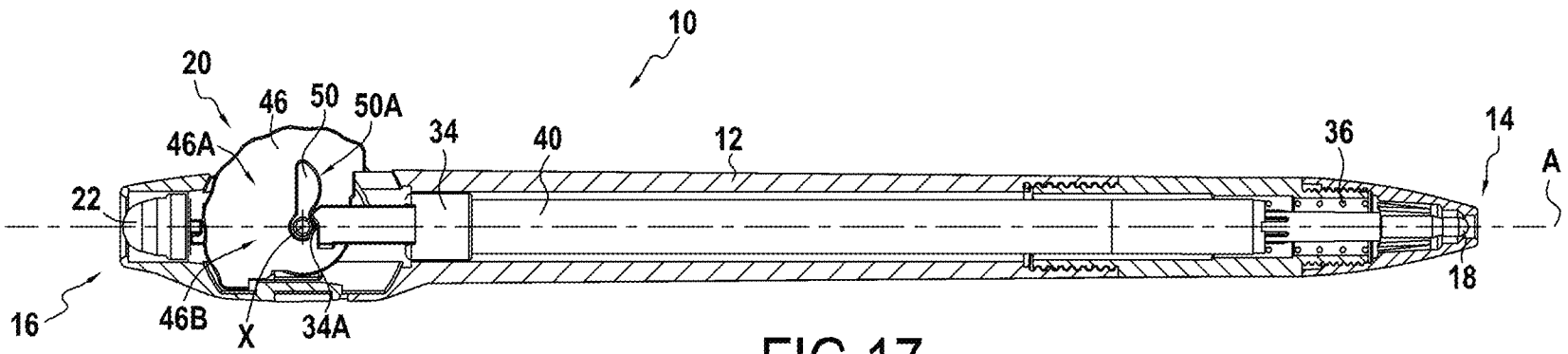

In FIGS. 7 and 9, the eraser 22 is in the use position and in FIGS. 8 and 10, the eraser 22 is in the protection position.

In the embodiment of FIGS. 7 to 10, in the protection position, the eraser 22 is received in the cover 30.

In the embodiment of FIGS. 7 to 10, the device for actuating the erasing device is formed by the erasing device 20.

In the embodiment of FIGS. 7 to 10, the writing head 18 of the writing instrument 10 can assume a writing position in which the writing head 18 protrudes from the body 12 of the writing instrument 10 and a retracted position in which the writing head 18 is stowed into the body 12 of the writing instrument 10.

As represented in FIGS. 7 to 10, the eraser holder 24 includes a pin 32 disposed at a given distance from the axis X. The pin 32 bears against a piston 34 sliding in the body 12 of the writing instrument 10. The piston 34 bears against a reservoir 40 on which the writing head 18 is mounted. The writing instrument 10 also comprises a spring 36 for returning the writing head into the retracted position.

When the eraser 22 is in the use position, the pin 32 is aligned along the axial direction A with the axis X, the pin 32 being closer to the first axial end 14 than the axis X. When the eraser 22 is in the protection position, the pin 32 is aligned along the axial direction A with the axis X, the pin 32 being further from the first axial end 14 than the axis X.

Thus, when the eraser 22 is in the use position, the writing head 18 is in the writing position, the piston 34 being moved in translation towards the first axial end 14 of the body 12 of the writing instrument 10. Conversely, when the eraser 22 is in the protection position, the writing head 18 is in the retracted position, the piston 34 being moved in translation towards the second axial end 16 of the body 12 of the writing instrument 10 and the head being returned by the spring 36 into the retracted position.

In the embodiment of FIGS. 7 to 10, the actuation device is formed by the erasing device 20, particularly when a user wishes to switch the eraser 22 from the use position to the protection position or vice versa, the user makes the erasing device 20 pivot about the axis X. Particularly, to switch from the protection position to the use position, the user can perform a rotational movement of the erasing device 20, that is to say of the actuation device, by bearing on the teeth 38 of the toothed wheel. The actuation device is therefore actuated along the axis X. Similarly, to switch from the use position to the protection position, the user can perform a rotational movement of the erasing device 20, that is to say, of the actuation device, by bearing on the teeth 38 of the toothed wheel. The actuation device is therefore actuated along the axis X. The eraser 22 switches from the use position to the protection position by a rotational movement of the eraser 22 about the axis X.

The embodiment of FIGS. 11 to 17 differs from the previously described embodiments in that the eraser 22 switches from the use position to the protection position, and vice versa, by translation of the eraser along the axial direction A.

In the protection position, the eraser 22 is received in the body 12 of the writing instrument 10.

In the embodiment of FIGS. 11 to 17, the actuation device 42 of the eraser is separate from the erasing device 20.

The erasing device 20 comprises the eraser 22.

The actuation device 42 comprises a rod 44 secured in displacement to the eraser 22. The rod 44 and the eraser 22 may be made of the same material and form only one piece. Alternatively, the eraser 22 may be overmolded on the rod 44 or the rod 44 may be snapped into the eraser 22.

The actuation device 42 comprises a wheel 46 pivotally mounted about the axis X. The actuation device 42 is therefore actuated along the axis X. The wheel 46 carries, on a first face 46A, an eraser cam 48 having an eraser cam surface 48A and, on a second face 46B, opposite to the first face, a writing head cam 50 having a writing head cam surface 50A.

The eraser cam 48 cooperates with a free end of the rod 44, particularly a cam surface 44A of the free end of the rod 44, and the writing head cam 50 cooperates with a free end of the piston 34, particularly a cam surface 34A of the free end of the piston 34.

As in the embodiment of FIGS. 7 to 10, in the embodiment of FIGS. 11 to 17, when the eraser 22 is in the use position, the writing head 18 is in the writing position and when the eraser 22 is in the protection position, the writing head 18 is in the retracted position, the writing head 18 being returned into the retracted position by the spring 36.

In the embodiment of FIGS. 11 to 17, the eraser 22 can assume the protection position under the effect of the Earth's gravity.

Figure 18:
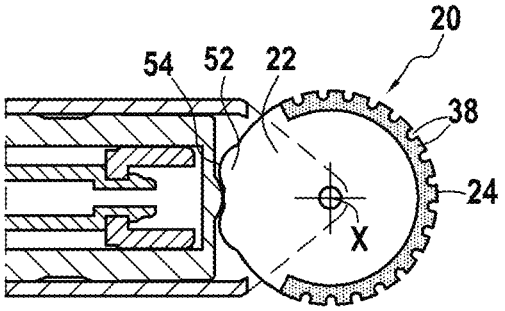
FIG. 18 is a partial sectional view of a writing instrument according to a fourth embodiment.

The embodiment of FIG. 18 differs from the embodiment of FIGS. 1 to 6 in that the eraser holder 24, which also forms the actuation device, includes the teeth 38 and in that the erasing device 20, in this case the eraser 22, comprises a blocking member 52 which, in cooperation with a blocking member 54 of the body 12 of the writing instrument 10, allows maintaining the eraser 22 in the protection position.

In the embodiment of FIG. 18, the actuation device is formed by the erasing device 20, particularly when a user wishes to switch the eraser 22 from the use position to the position protection or vice versa, the user makes the erasing device 20 pivot about the axis X. Particularly, to switch from the protection position to the use position, the user can perform a rotational movement of the erasing device 20, that is to say of the actuation device, by bearing on the teeth 38 of the erasing holder 24. The actuation device is therefore actuated along the axis X. Similarly, to switch from the use position to the protection position, the user can perform a rotational movement of the erasing device 20, that is to say of the actuation device, by bearing on the teeth 38 of the erasing holder 24. The actuation device is therefore actuated along the axis X. The eraser 22 switches from the use position to the protection position by a rotational movement of the eraser 22 about the axis X.

Although the present disclosure has been described with reference to a specific exemplary embodiment, it is obvious that various modifications and changes can be made to these examples without departing from the general scope of the disclosure as defined by the claims. In addition, individual characteristics of the various embodiments mentioned can be combined in additional embodiments. Consequently, the description and drawings should be considered in an illustrative rather than a restrictive way.

The invention claimed is:

1. A writing instrument comprising:

a body extending along an axial direction;

an erasing device;

an actuation device; and a writing head, the erasing device being disposed at a first axial end of the body of the writing instrument and is able to assume a use position and a protection position, the actuation device being configured for displacement along an axis perpendicular to the axial direction such that the erasing device is able to switch from the use position to the protection position, the writing head being disposed at a second axial end of the body and being configured to assume a writing position in which the writing head protrudes from the body and a retracted position in which the writing head is stowed into the body, and when the erasing device is in the use position, the writing head is in the writing position and when the erasing device is in the protection position, the writing head is in the retracted position, wherein the displacement of the erasing device comprises a rotational component that rotates about the axis that is perpendicular to the axial direction so that in order to switch from the protection position to the use position or to switch from the writing position and the retracted position, a rotational movement of the actuation device is performed, and wherein the actuation device has either a pin that bears against a piston or has a writing head cam that cooperates with a free end of a piston.

2. The writing instrument according to claim 1, wherein the erasing device includes an eraser and an eraser holder.

3. The writing instrument according to claim 2, wherein the eraser is received in the eraser holder by being snapped into the eraser holder.

4. The writing instrument according to claim 2, wherein the eraser is overmolded on the eraser holder.

5. The writing instrument according to claim 1, wherein the erasing device includes a stop member configured to maintain the erasing device in the use position.

6. The writing instrument according to claim 5, wherein the stop member is a lug.

7. The writing instrument according to claim 1, wherein the erasing device includes a blocking member configured to maintain the erasing device in the protection position.

8. The writing instrument according to claim 1, wherein the erasing device and the actuation device are separate from each other.

9. The writing instrument according to claim 1, wherein the actuation device is a toothed wheel.

10. The writing instrument according to claim 1, wherein the erasing device is a friction member for thermochromic ink.

11. The writing instrument according to claim 1, wherein the actuation device is formed by the erasing device.

12. A writing instrument comprising:

a body extending along an axial direction;

an erasing device;

an actuation device; and a writing head, the erasing device being disposed at a first axial end of the body of the writing instrument and is able to assume a use position and a protection position, the actuation device being configured for displacement along an axis perpendicular to the axial direction such that the erasing device is able to switch from the use position to the protection position, the writing head being disposed at a second axial end of the body and being configured to assume a writing position in which the writing head protrudes from the body and a retracted position in which the writing head is stowed into the body, and when the erasing device is in the use position, the writing head is in the writing position and when the erasing device is in the protection position, the writing head is in the retracted position, wherein the displacement of the erasing device comprises a rotational component that rotates about the axis that is perpendicular to the axial direction so that in order to switch from the protection position to the use position or to switch from the writing position and the retracted position, a rotational movement of the actuation device is performed, wherein the displacement of the erasing device comprises a translational component.

* * * * *